US007762348B2

(12) United States Patent
Stirm et al.

(10) Patent No.: US 7,762,348 B2
(45) **Date of Patent: *Jul. 27, 2010**

(54) VIBRATION REDUCTION APPARATUS FOR POWER TOOL AND POWER TOOL INCORPORATING SUCH APPARATUS

(75) Inventors: Michael Stirm, Oberursel (DE); Reimund Becht, Hühnfelden (DE); Norbert Hahn, Hühnstetten-Limbach (DE)

(73) Assignee: Black & Decker Inc., Newark, DE (US)

( * ) Notice: Subject to any disclaimer, the term of this patent is extended or adjusted under 35 U.S.C. 154(b) by 458 days.

This patent is subject to a terminal disclaimer.

(21) Appl. No.: 10/981,196

(22) Filed: Nov. 4, 2004

(65) Prior Publication Data

US 2006/0011365 A1 Jan. 19, 2006

(30) Foreign Application Priority Data

Nov. 4, 2003 (GB) ..... 0325640.1

(51) Int. Cl.
*B25D 17/00* (2006.01)
*B25D 17/24* (2006.01)

(52) U.S. Cl. ..... 173/162.2; 173/162.1

(58) Field of Classification Search ..... 173/162.1, 173/162.2, 48, 49; 267/137, 140.12, 141.1, 267/179; 16/430, 431

See application file for complete search history.

(56) References Cited

U.S. PATENT DOCUMENTS 1,358,486 A 11/1920 Wilhelm
2,629,364 A 2/1953 Anderson
2,630,784 A 3/1953 Wallerstein, Jr.
3,275,089 A 9/1966 Kaiser et al.
4,060,138 A * 11/1977 Cox et al. ..... 173/49
4,282,938 A 8/1981 Minamidate
4,371,043 A 2/1983 Kubokawa
4,401,167 A 8/1983 Sekizawa et al.
4,478,293 A 10/1984 Weilenmann et al.
4,611,671 A 9/1986 Hansson
4,667,749 A 5/1987 Keller (Continued)

FOREIGN PATENT DOCUMENTS

DE 10036078 2/2002

(Continued)

*Primary Examiner*—Rinaldi I. Rada
*Assistant Examiner*—Nathaniel Chukwurah
(74) *Attorney, Agent, or Firm*—Kofi Schulterbrandt; Scott B. Markow; Adan Ayala

(57) ABSTRACT

A power tool has a handle capable of limited movement mounted to its housing. An axle is rotatably connected to the housing and is movable between a first and second positions and is spring biased towards the first position. Arms are connected to and rotate with the axle. Connectors are slidably mounted within guides and are connected at one end to the arms and at the other end to the handle. Vibrations in the body of the power tool cause movement of one end of the handle, which causes movement of a connector and in turn movement of an arm. Movement of the arm causes rotation of the axle which therefore causes movement of the other arm. This in turn causes the related connector to slide within its guide and move the other end of handle. Thus, movement of one end of the handle is coupled to the other end.

20 Claims, 5 Drawing Sheets

U.S. PATENT DOCUMENTS

| | | | | |
|---|---|---|---|---|
| 4,673,043 | A | 6/1987 | Greppmaier | |
| 4,711,308 | A | 12/1987 | Blaas et al. | |
| 4,749,049 | A | 6/1988 | Greppmair | |
| 4,800,965 | A | 1/1989 | Keller | |
| 4,936,394 | A | 6/1990 | Ohtsu | |
| 5,025,870 | A | 6/1991 | Gantner | |
| 5,157,807 | A | 10/1992 | Keller et al. | |
| 5,522,466 | A * | 6/1996 | Harada et al. | 173/162.2 |
| 5,697,456 | A * | 12/1997 | Radle et al. | 173/162.2 |
| 5,921,327 | A * | 7/1999 | Henriksson et al. | 173/210 |
| H1811 | H | 11/1999 | Rescigno | |
| 6,076,616 | A * | 6/2000 | Kramp et al. | 173/162.2 |
| 6,123,158 | A | 9/2000 | Steffen | |
| 6,148,930 | A | 11/2000 | Berger et al. | |
| 6,375,171 | B1 | 4/2002 | Zimmermann et al. | |
| 6,421,880 | B1 | 7/2002 | Prajapati et al. | |
| 6,446,421 | B1 | 9/2002 | Kramer et al. | |
| 6,766,868 | B2 | 7/2004 | Frauhammer et al. | |
| 6,843,327 | B2 | 1/2005 | Meixner et al. | |
| 6,863,479 | B2 | 3/2005 | Frauhammer et al. | |
| 7,076,838 | B2 * | 7/2006 | Meixner | 16/431 |
| 7,100,706 | B2 | 9/2006 | Meixner et al. | |
| 7,472,760 | B2 * | 1/2009 | Stirm et al. | 173/162.1 |
| 2001/0011846 | A1 | 8/2001 | Kondorfer et al. | |
| 2002/0197939 | A1 | 12/2002 | Frauhammer et al. | |
| 2003/0006051 | A1 | 1/2003 | Schmitzer et al. | |
| 2003/0037937 | A1 | 2/2003 | Frauhammer et al. | |
| 2003/0132016 | A1 | 7/2003 | Meixner et al. | |
| 2004/0040729 | A1 * | 3/2004 | Meixner | 173/162.2 |
| 2004/0231867 | A1 * | 11/2004 | Becht et al. | 173/162.2 |
| 2005/0082072 | A1 | 4/2005 | Nicolantonio et al. | |
| 2005/0263307 | A1 | 12/2005 | Stirm et al. | |
| 2005/0284646 | A1 | 12/2005 | Bacila | |
| 2006/0011365 | A1 | 1/2006 | Stirm et al. | |
| 2007/0107165 | A1 | 5/2007 | Oddo et al. | |

FOREIGN PATENT DOCUMENTS

| | | |
|---|---|---|
| DE | 100 52 447 A1 | 5/2002 |
| DE | 4124574 | 1/2003 |
| EP | 0 033 304 A1 | 8/1981 |
| EP | 1221359 | 7/2002 |
| GB | 2154497 | 9/1985 |
| GB | 2 171 045 A | 8/1986 |
| GB | 2297514 | 8/1996 |
| GB | 2407057 | 4/2005 |

* cited by examiner

VIBRATION REDUCTION APPARATUS FOR POWER TOOL AND POWER TOOL INCORPORATING SUCH APPARATUS

FIELD OF THE INVENTION

The present invention relates to vibration reduction apparatus for power tools and to power tools incorporating such apparatus. The invention relates particularly, but not exclusively, to vibration reduction apparatus for power hammers, and to hammers incorporating such apparatus.

BACKGROUND OF THE INVENTION

Electrically driven hammers are known in which a driving member in the form of a flying mass is reciprocally driven in a piston, and impact of the flying mass against the end of the piston imparts a hammer action to a bit of the hammer. Such an arrangement is disclosed in European patent application EP1252976 and is shown in FIG. 1.

Referring in detail to FIG. 1, the prior art demolition hammer comprises an electric motor 2, a gear arrangement and a piston drive arrangement which are housed within a metal gear housing 5 surrounded by a plastic housing 4. A rear handle housing incorporating a rear handle 6 and a trigger switch arrangement 8 is fitted to the rear of the housings 4, 5. A cable (not shown) extends through a cable guide 10 and connects the motor to an external electricity supply. When the cable is connected to the electricity supply when the trigger switch arrangement 8 is depressed, the motor 2 is actuated to rotationally drive the armature of the motor. A radial fan 14 is fitted at one end of the armature and a pinion is formed at the opposite end of the armature so that when the motor is actuated the armature rotatingly drives the fan 14 and the pinion. The metal gear housing 5 is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear housing 5. The intermediate gear has a second gear wheel which rotatingly drives a drive gear. The drive gear is non-rotatably mounted on a drive spindle mounted within the gear housing 5. A crank plate 30 is non-rotatably mounted at the end of the drive spindle remote from the drive gear, the crank plate being formed with an eccentric bore for housing an eccentric crank pin 32. The crank pin 32 extends from the crank plate into a bore at the rearward end of a crank arm 34 so that the crank arm can pivot about the crank pin 32. The opposite forward end of the crank arm 34 is formed with a bore through which extends a trunnion pin 36 so that the crank arm 34 can pivot about the trunnion pin 36. The trunnion pin 36 is fitted to the rear of a piston 38 by fitting the ends of the trunnion pin 36 into receiving bores formed in a pair of opposing arms which extend to the rear of the piston 38. The piston is reciprocally mounted in cylindrical hollow spindle 40 so that it can reciprocate within the hollow spindle. An O-ring seal 41 is fitted in an annular recess formed in the periphery of the piston 38 so as to form an airtight seal between the piston 38 and the internal surface of the hollow spindle 40.

When the motor 2 is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate 30 and the crank arm arrangement comprising the crank pin 32, the crank arm 34 and the trunnion pin 36 converts the rotational drive from the crank plate 30 to a reciprocating drive to the piston 38. In this way the piston 38 is reciprocatingly driven back and forth along the hollow spindle 40 when the motor is actuated by a user depressing the trigger switch 8.

The spindle 40 is mounted in magnesium casing 42 from the forward end until an annular rearward facing shoulder (not shown) on the exterior of the spindle butts up against a forward facing annular shoulder (not shown) formed from a set of ribs in the interior of the magnesium casing 42. The ribs enable air in the chamber surrounding the spindle 40 to circulate freely in the region between a ram 58 and a beat piece 64. An increased diameter portion on the exterior of the spindle fits closely within a reduced diameter portion on the interior of the magnesium casing 42. Rearwardly of the increased diameter portion and the reduced diameter portion an annular chamber is formed between the external surface of the spindle 40 and the internal surface of the magnesium casing 42. This chamber is open at its forward and rearward ends. At its forward end the chamber communicates via the spaces between the ribs in the magnesium casing with a volume of air between the ram 58 and the beat piece 64. At its rearward end the chamber communicates via the spaces between the ribs 7 and the recess of the gear casing 5 with a volume of air in the gear casing 5.

The volume of air in the gear casing 5 communicates with the air outside of the hammer via a narrow channel 9 and a filter 11. The air pressure within the hammer, which changes due to changes in the temperature of the hammer, is thus equalised with the air pressure outside of the hammer. The filter 11 also keeps the air within the hammer gear casing 5 relatively clean and dust free.

The ram 58 is located within the hollow spindle 40 forwardly of the piston 38 so that it can also reciprocate within the hollow spindle 40. An O-ring seal 60 is located in a recess formed around the periphery of the ram 58 so as to form an airtight seal between the ram 58 and the spindle 40. In the operating position of the ram 58 (shown in the upper half of FIG. 1), with the ram located behind bores 62 in the spindle, a closed air cushion is formed between the forward face of the piston 38 and the rearward face of the ram 58. Reciprocation of the piston 38 thus reciprocatingly drives the ram 58 via the closed air cushion. When the hammer enters idle mode (i.e. when the hammer bit is removed from a work piece), the ram 58 moves forwardly, past the bores 62 to the position shown in the bottom half of FIG. 1. This vents the air cushion and so the ram 58 is no longer reciprocatingly driven by the piston 38 in idle mode, as is known to persons skilled in the art.

Known hammer drills of this type suffer from the drawback that the hammer action generates significant vibrations, which can be harmful to users of the apparatus, and can cause damage to the apparatus itself.

Solutions to this problem have been proposed, for example, by including in devices of the type shown in FIG. 1 compression springs between either end of handle 6 and the body of the device. However, such springs can cause the handle 6 to experience a rocking motion which results from the spring at one end of handle 6 being compressed whilst the spring at the other end is extended. This is then followed by the previously compressed spring extending whilst the previously extended spring becomes compressed. This rocking motion of the handle is extremely uncomfortable and can be dangerous to the user of the power tool. In particular, the rocking motion is then damped by flexing of the user's wrist, and such repeated flexing sustained by regular long-term use of the power tool could lead to a number of debilitating disorders.

An alternative solution to the above problem is described in European patent application EP0033304 and is shown in FIG.

2. Referring to FIG. 2, the prior art demolition hammer has a pair of handles 102 which are connected to axle 105 by first arms 113. Axle 105 is fixed to housing 101 but is able to rotate relative thereto. Second arms 106 are connected at one end to axle 105 and at the other to compression springs 111, which are themselves connected at their other end to housing 101. As a result, any rotation of axle 105 causes the compression or extension of springs 111. Therefore, any movement of one of handles 102 is transferred down one first handle 113 via axle 105 and along the other first handle 113 to the other hand 102 whilst being damped by springs 111. However, because handles 102 move through an arc there remains a twisting element to the motion of handles 102 as a result of which the device described in EP0033304 cannot easily be adapted to devices of the type shown in FIG. 1.

Another problem with devices of the prior art is that the vibration-damping device is large, requiring additional space within the housing of the power tool, and the additional components add weight to the tool, which is also undesirable.

A further problem associated with the prior art is that under different circumstances different spring tensions produce more effective damping of vibrations. It is therefore known to produce power tools having adjustable spring tensioning means, such as that described in EP0033304. However, such devices typically require the housing of the tool to be removed in order to access the tension adjusting means. Furthermore, once access has been established it is also typical to require a specific tool to make the tension adjustment. As a result the tension is rarely adjusted and the full benefit of the vibration damping apparatus is not utilised.

Preferred embodiments of the present invention seek to overcome the above-described disadvantages of the prior art.

BRIEF SUMMARY OF THE INVENTION

According to an aspect of the present invention there is provided a handle assembly for a power tool, the assembly comprising:

- handle means adapted to be held by a user of the power tool and to be mounted to a housing of the power tool such that the handle means is capable of movement relative to the housing;
- axle means adapted to be attached to the housing and to be rotated relative to the housing between a first position and a second position;
- biasing means for urging said axle means towards said first position;
- at least one arm adapted to pivot with said axle means; and
- a plurality of connectors connected between said handle means and at least one said arm for converting rotational movement of the or each arm into substantially linear movement of said handle means.

By attaching the handle means of a power tool to axle means via at least one arm and connectors, the advantage is provided that vibrations in the handle are damped more effectively than in the prior art. Furthermore, the vibrations are damped without conversion into vibrations in a different direction. In particular, when vibrations cause the movement of one end of the handle, the axle means, in combination with the or each arm and connectors, transfers some of that vibration to the other end of the handle means whilst the biasing means damps the vibration. As a result, the rocking motion of the handle means, as experienced in the prior art, where the spring at one end of the handle means is able to be compressed whilst the spring at the other end of the handle can be extended, is reduced. Consequently, the uncomfortable and potentially damaging flexing of the wrist is similarly reduced. Furthermore, because of the linkage of arms and connectors with the handle means, the further advantage is provided that the handle means is not caused to twist in the hand of the user. Thus the reduction or removal of one form of vibration does not introduce an alternative undesirable vibration. This combination of advantages provides a significantly and surprisingly improved reduction in the vibrations of this type of apparatus compared to that experienced in the prior art.

The assembly may further comprise guide means adapted to be connected to said housing and to have said connectors slidably mounted therein.

By providing guide means within which the connectors are slidably mounted the advantage is provided that any non-linear movement of the handle means relative to the housing, such as rattling, is further reduced.

In a preferred embodiment, the axis of rotation of the axle means is substantially parallel to a major dimension of the handle means.

In a preferred embodiment, the handle means comprises a handle, at least one first said connector is attached adjacent a first end of said handle and at least one second said connector is attached adjacent a second end of said handle.

The biasing means may comprise at least one helical spring.

The biasing means may comprise at least one leaf spring.

The biasing means may comprise torsional biasing means.

By using a torsional biasing means to urge the axle means towards the first position, the advantage is provided that the biasing means can be of particularly compact construction since it can extend around or within the axle means. This results in a significant reduction in the space required within the housing to provide effective damping. Furthermore the torsional biasing means does not add significantly to the weight of the device and is surprisingly effective, for its weight, in vibration reduction when compared to devices of the prior art.

In a preferred embodiment, said axle means comprises at least one hollow portion and said torsional biasing means is at least partially located therein.

By locating the torsional biasing means within a hollow portion of the axle means, this provides the advantage that the combined volume required for the axle means and biasing means can be significantly reduced.

In a preferred embodiment the assembly further comprises adjustment means for adjusting the biasing force of said biasing means.

By providing means for adjusting the biasing force of the biasing means, the advantage is provided that the user is able to select a biasing force in the biasing means which provides a damping effect of the handle which best suits the circumstances in which the tool is being used.

In a preferred embodiment said adjustment means is adapted to adjust said biasing force in said biasing means by moving and fixing a portion of said biasing means relative to said housing.

In another preferred embodiment said adjust means comprises at least one cam.

By providing a cam which operates in the manner described above, this provides the advantage that the cam can be operated by a lever extending outside the housing of the power tool which is rotated to alter the tension in the spring. As a result it is not necessary to gain access within the housing of the tool to alter the tension of the spring, nor is it necessary to use a specific tool.

In a further preferred embodiment rotation of said cam causes movement of a portion of said biasing means in a direction substantially parallel to the axis of rotation of the cam.

By providing the adjusting means such that the rotation of the cam results in movement of the biasing means in a direction which is substantially parallel to axis of rotation of the cam, the advantage is provided that a large movement of the lever can result in a small movement of the portion of the biasing means which is engaged with the cam. This therefore allows for considerable sensitivity in the adjustment in the tension of the biasing means.

According to another aspect of the present invention, there is provided a power tool comprising:

a housing;

a motor in the housing for actuating a working member of the tool; and a handle assembly as defined above.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE INVENTION

Figure 1:
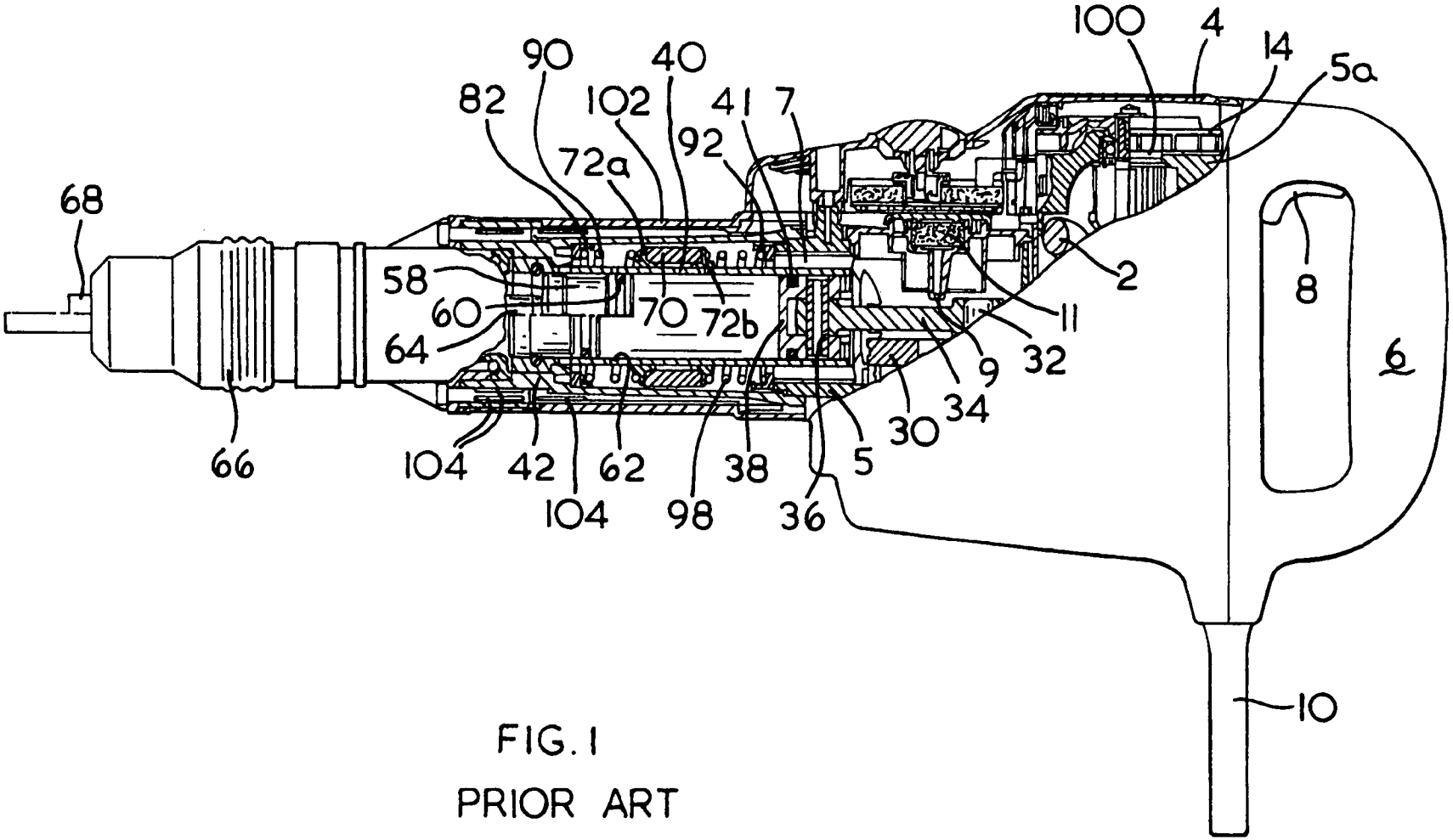
FIG. 1 PRIOR ART
FIG. 1 is a partially cut away side view of a first prior art demolition hammer.
Figure 2:
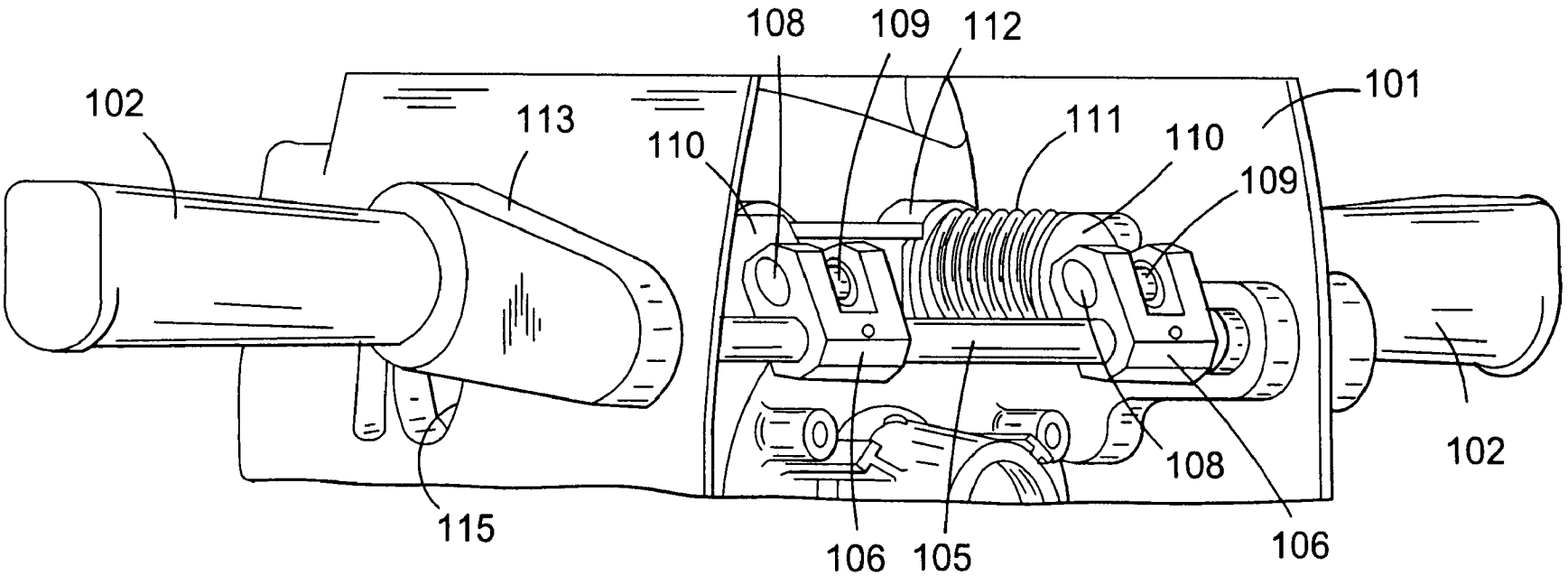
FIG.2 PRIOR ART
FIG. 2 is a perspective view of a handle assembly of a second prior art demolition hammer.
Figure 3:
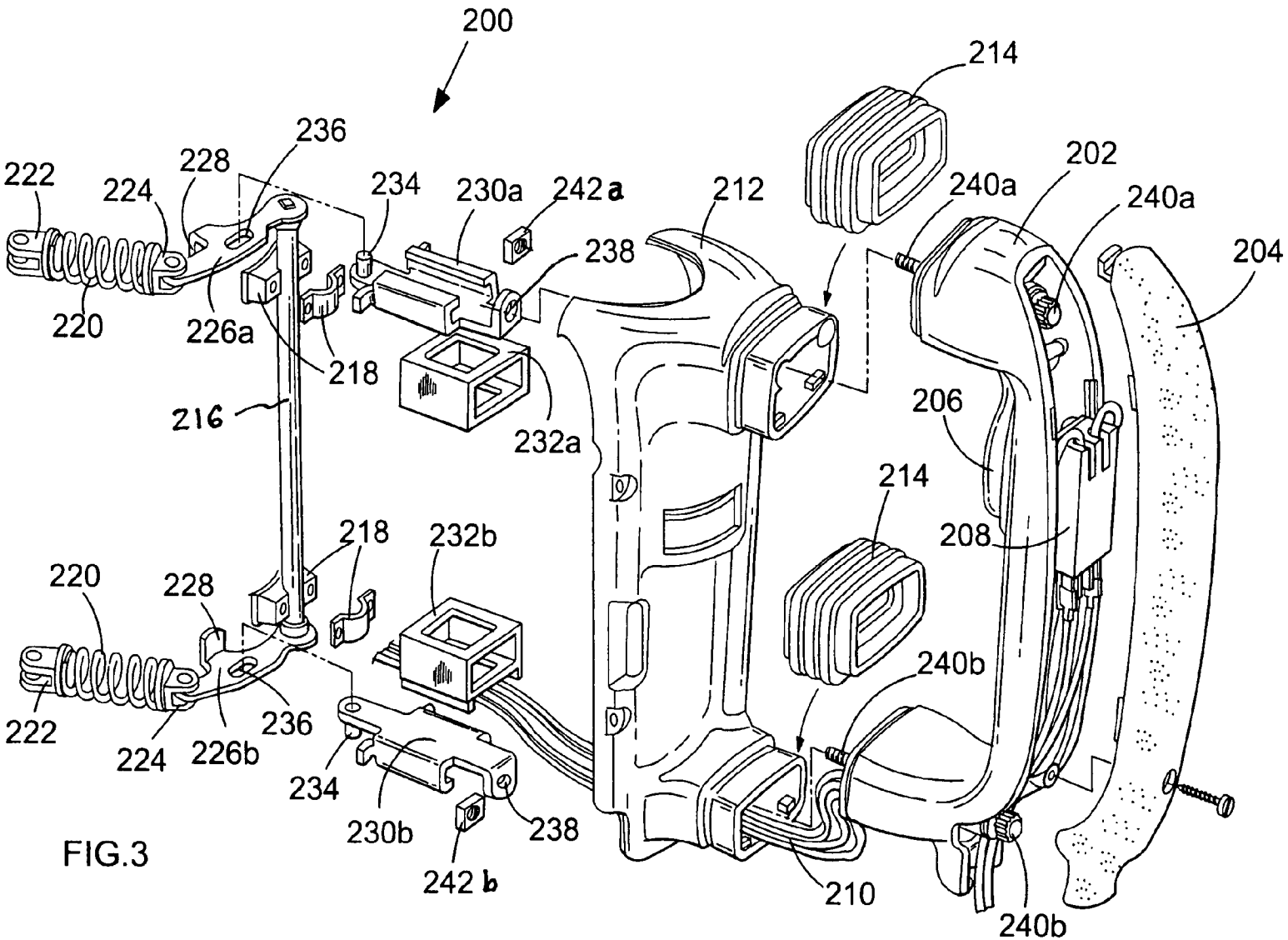
FIG. 3 is an exploded perspective view of a handle assembly of a first embodiment of the present invention.

Referring to FIG. 3, a handle assembly 200 of a first embodiment of the invention for use as part of a power hammer (not shown) has a handle 202 which has a rubberised gripping portion 204. Handle 202 also has a trigger 206 which activates switch 208 and provides power to the hammer mechanism via cables 210.

Handle 202 is mounted to the housing 212 of the power tool, only a portion of which is shown in FIG. 3, and handle 202 is capable of limited movement relative to housing 212. Rubberised sleeves 214 cover the joint between handle 202 and housing 212. The handle assembly also has an axle 216 which is attached to the housing 212 by brackets 218 and is able to rotate relative to the housing 212 between a first position and a second position. Axle 216 is biased towards said first position by biasing means in the form of helical springs 220. Springs 220 are fixed relative to the housing 212 at first ends 222, whilst second ends 224 are able to move relative to the housing 212. Second ends 224 are attached to arms 226*a* and 226*b* which are fixed relative to axle 216 such that rotation of axle 216 causes rotation of arms 226*a* and 226*b*. Stops 228 engage respective portions (not shown) of the housing 212 thereby preventing movement of arms 226*a* and 226*b* beyond a predetermined position.

The handle assembly 200 also has connectors 230*a* and 230*b* which are slidably mounted within guides 232*a* and 232*b* respectively, which are themselves fixed relative to housing 212. Connectors 230*a* and 230*b* have a respective pin 234 at one end which extends into respective aperture 236 in arms 226*a* and 226*b*. At the other end of each connector 230*a* and 230*b* apertures 238 receive bolts 240*a* and 240*b* respectively and the connectors 230*a* and 230*b* are fixed to the handle 202 by means of respective nuts 242*a* and 242*b*. Bolts 240*a* and 240*b* extend into and are fixed relative to handle 202.

In use, if vibrations in the body of the power tool, such as a hammer, to which handle assembly 200 is connected cause movement of one end, for example the upper end as shown in FIG. 3, of handle 202 relative to housing 212, movement of handle 202 causes movement of connector 230*a* since it is fixed relative to handle 202 by bolt 240*a* which extends through hole 238 and is fixed by nut 242. Movement of connector 230*a* in turn causes movement of arm 226*a*, which is damped by spring 220. At the same time, movement of arm 226*a* causes rotation of axle 216 which therefore causes movement of the other arm 226*b*. As a result, movement of one arm 226*a* automatically causes the movement of the other arm 226*b*. Movement of arm 226*b* in turn causes connector 230*b* to slide within guide means 232*b* and by virtue of the fixed connection between connector 230*b* and bolt 240*b*, the lower end of handle 202 is caused to move relative to housing 212.

As a result, it can be seen that movement of one end of handle 202 will result in an equivalent movement of the other end of handle 202. Thus the tendency for the opposing ends of handle 202 to pivot about an axis transverse to the longitudinal axis of the handle 202, and the resultant dangerous flexing of the wrist, is reduced. The use of connectors 230*a* and 230*b* further ensures that the movement of handle 202 does not rotate along its length as a result of the movement of arms 226*a* and 226*b*.

Figure 4:
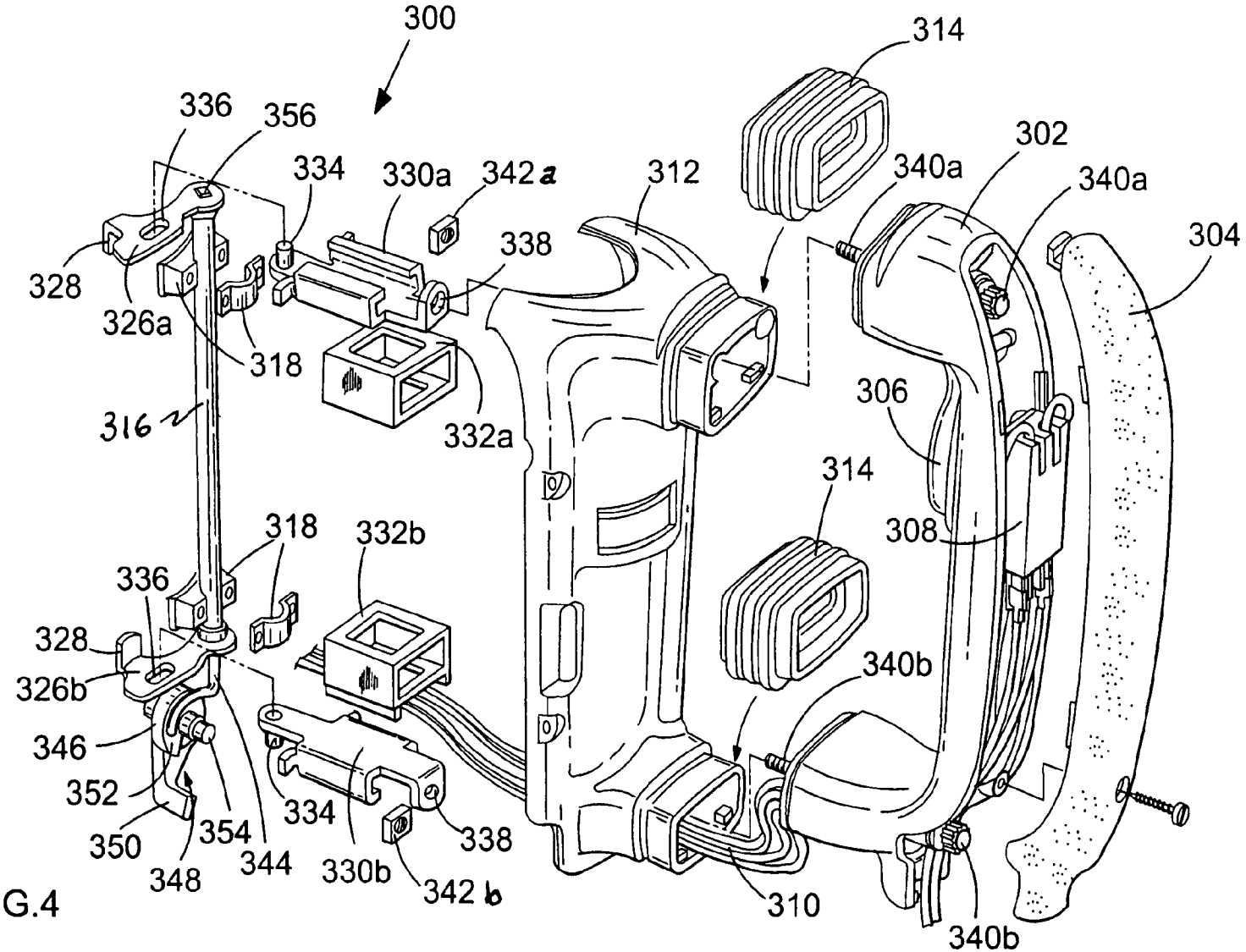
FIG. 4 is an exploded perspective view, corresponding to FIG. 3, of a handle assembly of a second embodiment of the present invention.

Referring now to FIG. 4, in which parts common with the embodiments of FIG. 3 are denoted by like reference numerals but increased by 100, handle assembly 300 works on the same principle as that described with reference to FIG. 3, except that the biasing means is a torsional spring 344 which extends within axle 316, which is hollow. Torsional spring 344 has an engaging arm 346 which extends approximately perpendicularly to the axis of spring 344 and axle 316. The position of engaging portion 346 is fixed relative to the housing 312 by adjusting means 348. Adjusting means 348 has a lever 350 which extends outside the housing of the power tool to enable it to be actuated by a user of the tool. It also has a cam surface 352 and is mounted on and rotatable at least partially around an axle 354. The body of torsional spring 344 is able to rotate relative to axle 316 at the lower end (adjacent arm 326*b*) but is fixed at the upper end (adjacent arm 326*a*). Spring portion 356 can be seen extending through arm 326*a* thereby fixing that end of spring 344 relative to arm 326*a* and at that end of axle 316.

In use, torsional spring 344 causes axle 316 and arms 326*a* and 326*b* to be urged towards a first position. As previously described, any movement of arm 326*a* causes equivalent movement of arm 326*b* by transfer of rotation along axle 316.

The tension in torsional spring 344 may be adjusted by movement of adjusting means 348. Lever 350 is moved, causing rotation of adjusting means 348 around axle 354. As a result of this rotation, cam surface 352 causes arm portion 346 of spring 344 to be moved axially along axle 354. As a result, more or less tension is applied to torsional spring 344, depending on the position of lever 350.

Figure 5:
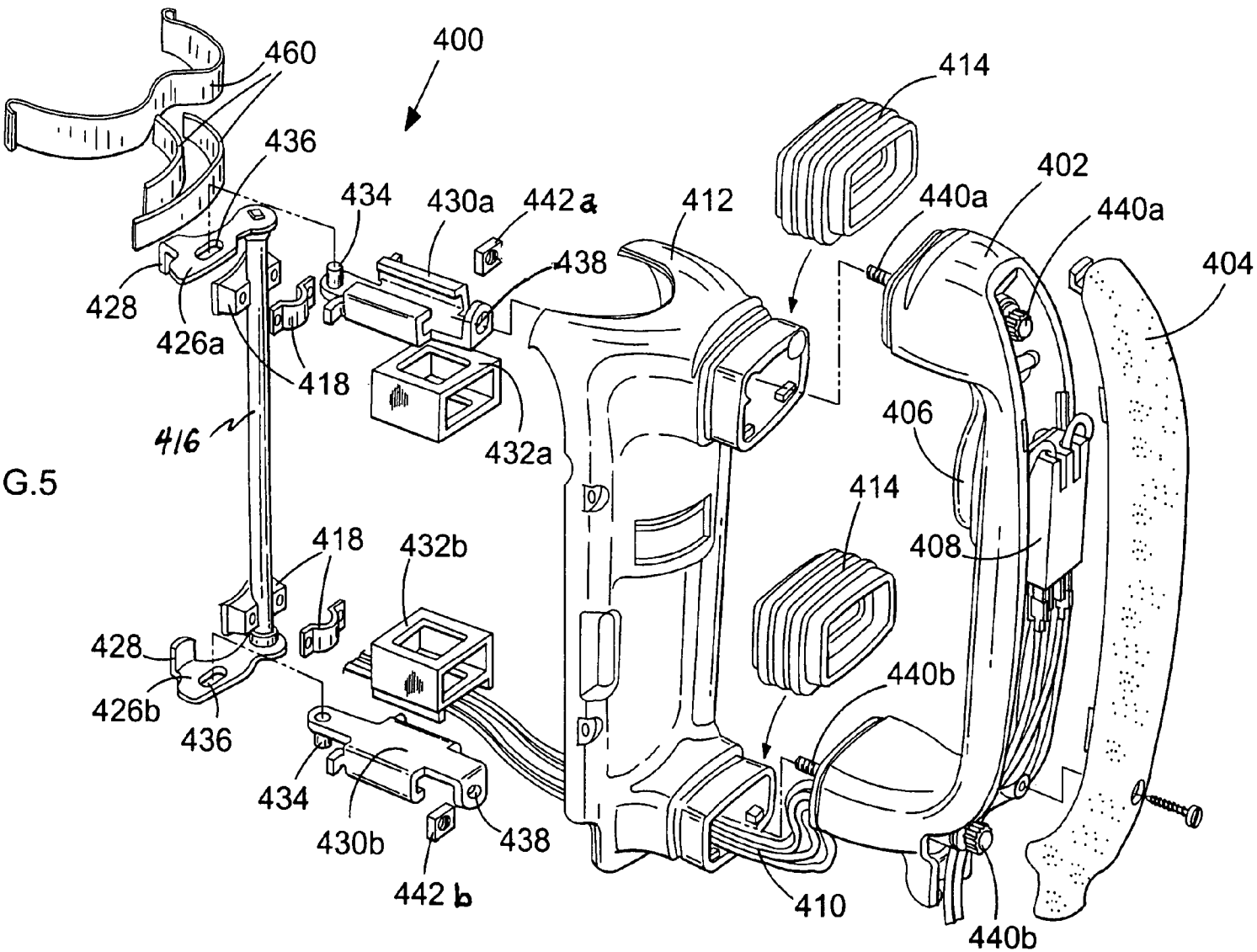
FIG. 5 is an exploded perspective view, corresponding to FIG. 3, of a handle assembly of a third embodiment of the present invention.

Finally, referring to FIG. 5, in which parts in common with the embodiment of FIG. 3 are denoted by like reference numerals but increased by 200, a handle assembly 400 has one or more leaf springs 460. Leaf springs 460 act on arms 436, thereby urging axle 416 towards a first position, and the handle 402 moves in the same way as that described with reference to FIG. 3.

It will be appreciated by persons skilled in the art that the above embodiments have been described by way of example only, and not in any limitative sense, and that various alterations and modifications are possible without departure from the scope of the invention as defined by the appended claims.

The invention claimed is:

1. A handle assembly for a power tool, the assembly comprising:

a handle adapted to be held by a user of the power tool and to be mounted to a housing of the power tool such that the handle is capable of movement relative to the housing;

an axle adapted to be attached to the housing and to be rotated relative to the housing between a first position and a second position;

a biasing means for urging said axle towards said first position;

an arm adapted to pivot with said axle;

a connector connected between said handle and said arm for converting rotational movement of the arm into substantially linear movement of said handle, and a guide connected to said housing and said connector slidably mounted in the guide.

2. An assembly according to claim 1, wherein said connector is a first connector attached adjacent a first end of said handle, and the assembly further comprises a second connector attached adjacent a second end of said handle.

3. An assembly according to claim 1, wherein said axle comprises a hollow portion and a torsional biasing spring is at least partially located inside said hollow portion.

4. An assembly according to claim 1, further comprising adjustment means for adjusting the biasing force of said biasing means.

5. An assembly according to claim 4, wherein said adjustment means is adapted to adjust the biasing force of said biasing means by moving and fixing a portion of said biasing means relative to said housing.

6. An assembly according to claim 4, wherein said adjust means comprises at least one cam.

7. An assembly according to claim 6, wherein rotation of said cam causes movement of a portion of said biasing means in a direction substantially parallel to the axis of rotation of the cam.

8. A handle assembly for a power tool according to claim 1 wherein the guide is fixed relative to the housing and constrains the connector for substantially linear movement.

9. A handle assembly for a power tool according to claim 8 and further including a pivoting joint between the rotatable arm and the linearly slideable connector.

10. A power tool comprising:

a housing;

a motor in the housing for actuating a working member of the tool; and a handle assembly comprising:

a handle adapted to be held by a user of the power tool and to be mounted to the housing of the power tool such that the handle is capable of movement relative to the housing;

an axle adapted to be attached to the housing and to be rotated relative to the housing between a first position and a second position;

a biasing means for urging said axle towards said first position;

an arm adapted to pivot with said axle;

a connector connected between said handle and said arm for converting rotational movement of the arm into substantially linear movement of said handle; and a guide connected to said housing and said connector slidably mounted in the guide.

11. A power tool according to claim 10, wherein the axis of rotation of the axle is substantially parallel to a major dimension of the handle.

12. A power tool according to claim 11, wherein said connector is a first connector attached adjacent a first end of said handle, and the assembly further comprises a second connector attached adjacent a second end of said handle.

13. A power tool according to claim 10, wherein the biasing means comprises at least one helical spring.

14. A power tool according to claim 10, wherein the biasing means comprises torsional biasing means.

15. A power tool according to claim 10, further comprising adjustment means for adjusting the biasing force of said biasing means.

16. A power tool according to claim 15, wherein said adjust means comprises at least one cam.

17. A power tool according to claim 10, wherein the guide is fixed relative to the housing and constrains the connector for substantially linear movement.

18. A power tool according to claim 17, and further including a pivoting joint between the rotatable arm and the linearly slideable connector.

19. A power tool comprising:

a housing including a first handle connecting portion and a second handle connecting portion;

a motor in the housing for actuating a working member of the tool; and a handle assembly comprising:

a handle adapted to be held by a user of the power tool, the handle having a substantially C shape and including a first end portion and a second end portion and a middle grip portion, the handle first end portion mounted to the housing at the first handle connecting portion and the handle second end portion mounted to the housing at the second handle connecting portion such that the handle is movable relative to the housing;

an axle mounted within the housing and rotatable relative to the housing between a first rotational position and a second rotational position, the axle extending substantially between the first end portion and the second end portion of the C shaped handle;

a biasing spring urging said axle towards the first rotational position;

an first radial arm extending from the axle and a second radial arm extending from the axle at an axial distance from and parallel to the first radial arm;

a first connector pivotably connected at a first end thereof to the first radial arm and connected at a second end thereof to the first end portion of the handle, and a second connector pivotably connected at a first end thereof to the second radial arm and connected at a second end thereof to the second end portion of the handle, for converting rotational movement of the axle into substantially linear movement of said handle; and wherein said power tool further comprises a first guide connected to said housing with said first connector slidably mounted in the first guide for translating the rotation of the first radial arm into substantially linear movement of the first end portion of the handle.

20. A power tool comprising:

a housing including a first handle connecting portion and a second handle connecting portion;

a motor in the housing for actuating a working member of the tool; and a handle assembly comprising:

a handle adapted to be held by a user of the power tool, the handle having a substantially C shape and including a first end portion and a second end portion and a middle grip portion, the handle first end portion mounted to the housing at the first handle connecting portion and the handle second end portion mounted to the housing at the second handle connecting portion such that the handle is movable relative to the housing;

an axle mounted within the housing and rotatable relative to the housing between a first rotational position and a second rotational position, the axle extending substantially between the first end portion and the second end portion of the C shaped handle;

a biasing spring urging said axle towards the first rotational position;

an first radial arm extending from the axle and a second radial arm extending from the axle at an axial distance from and parallel to the first radial arm;

a first connector pivotably connected at a first end thereof to the first radial arm and connected at a second end thereof to the first end portion of the handle, and a second connector pivotably connected at a first end thereof to the second radial arm and connected at a second end thereof to the second end portion of the handle, for converting rotational movement of the axle into substantially linear movement of said handle; and wherein the axle comprises a hollow portion, and the biasing spring comprises a torsion spring at least partially located inside the hollow portion.

* * * * *